US009538267B2

(12) United States Patent
Barnas

(10) Patent No.: US 9,538,267 B2
(45) Date of Patent: Jan. 3, 2017

(54) SOUND PROTECTION COMPONENT

(75) Inventor: Alexander Barnas, Vienna (AT)

(73) Assignee: KIRCHDORFER FERTIGTEILHOLDING GMBH, Wöllersdorf (AT)

( * ) Notice: Subject to any disclaimer, the term of this patent is extended or adjusted under 35 U.S.C. 154(b) by 0 days.

(21) Appl. No.: 13/997,105

(22) PCT Filed: Dec. 14, 2011

(86) PCT No.: PCT/AT2011/000495

§ 371 (c)(1),
(2), (4) Date: Jun. 21, 2013

(87) PCT Pub. No.: WO2012/083319

PCT Pub. Date: Jun. 28, 2012

(65) Prior Publication Data

US 2013/0272551 A1 Oct. 17, 2013

(30) Foreign Application Priority Data

Dec. 23, 2010 (AT) ..... A 2125/2010

(51) Int. Cl.
*H04R 1/00* (2006.01)
*E01F 8/00* (2006.01)

(52) U.S. Cl.
CPC ..... *H04R 1/00* (2013.01); *E01F 8/0029* (2013.01)

(58) Field of Classification Search
USPC ..... 181/207
See application file for complete search history.

(56) References Cited

U.S. PATENT DOCUMENTS

| | | | | |
|---|---|---|---|---|
| 3,656,576 | A * | 4/1972 | Gubela | 181/210 |
| 3,656,577 | A * | 4/1972 | Larsson et al. | 181/285 |
| 4,094,379 | A * | 6/1978 | Steinberger | 181/284 |
| 4,199,639 | A * | 4/1980 | Ronc | A63C 19/04 428/137 |
| 4,356,880 | A * | 11/1982 | Downs | 181/30 |
| 4,674,593 | A * | 6/1987 | McCarty | 181/210 |
| 7,184,562 | B2 * | 2/2007 | Seki et al. | 381/160 |
| 7,400,736 | B2 * | 7/2008 | Dedieu et al. | 381/160 |
| 7,445,084 | B2 * | 11/2008 | Berbner | B22F 3/002 181/282 |
| 7,694,567 | B2 * | 4/2010 | Haupt et al. | 73/627 |
| 2003/0006090 | A1 * | 1/2003 | Reed | 181/210 |
| 2006/0037809 | A1 * | 2/2006 | Fuller | F16F 1/361 181/207 |
| 2009/0065290 | A1 * | 3/2009 | Kim | 181/141 |

FOREIGN PATENT DOCUMENTS

| | | | |
|---|---|---|---|
| DE | 34 12 921 | A1 | 10/1985 |
| DE | 42 20 547 | A1 | 1/1993 |
| DE | 299 13 101 | U1 | 9/1999 |
| FR | 2 873 389 | A1 | 1/2006 |
| GB | 1 481 218 | A | 7/1977 |
| WO | WO 94/24381 | A1 | 10/1994 |

OTHER PUBLICATIONS

International Search Report issued by the European Patent Office in International Application PCT/AT2011/000495.

* cited by examiner

*Primary Examiner* — Amir Etesam
(74) *Attorney, Agent, or Firm* — Henry M. Feiereisen LLC

(57) ABSTRACT

A sound protection component includes an absorber element and a reflection element, the absorber element being of self-supporting design.

11 Claims, 2 Drawing Sheets

SOUND PROTECTION COMPONENT

CROSS-REFERENCES TO RELATED APPLICATIONS

This application is the U.S. National Stage of International Application No. PCT/AT2011/000495, filed Dec. 14, 2011, which designated the U.S. and has been published as International Publication No. WO 2012/083319 A2 and which claims the priority of Austrian Patent Application, Serial No. A 2125/2010, filed Dec. 23, 2010, pursuant to 35 U.S.C. 119(a)-(d).

BACKGROUND OF THE INVENTION

The invention relates to a sound protection component.

Increased environmental awareness and increasing knowledge of the hazardous effects of noise on the body and psyche of the population lead to an increasing use of sound protection components on or adjacent to traffic routes in order to reduce the noise exposure of the population.

Sound protection components such as sound-absorbing panels are known which comprise a support or base body which is usually made of normal concrete and which forms a supporting structure. A layer for the absorption of airborne sound is then arranged on said base body, which layer faces the expected source of the noise. Such a layer is formed by growth of plants or by a layer of a porous material such as bulk-porous lightweight concrete.

It is disadvantageous in such known sound protection components that they have a large thickness. Furthermore, retrofitting existing traffic routes is often difficult as a result of the required need for space.

SUMMARY OF THE INVENTION

It is therefore the object of the invention to provide a sound protection component of the kind mentioned above with which the mentioned disadvantages can be avoided and which has a low thickness and can be adjusted easily to the various requirements.

This is achieved in accordance with the invention by a sound protection component, including an absorber element; and a reflection element, wherein the absorber element being arranged in a self-supporting manner.

This leads to the advantage that the sound protection component can be thinner than conventional sound protection components, but still offer the same sound protection properties. Consequently, the area required for sound protection will be reduced. As a result, sound protection can be improved in areas where there is little available area for sound protection such as on bridges or in cities. The input of material for sound protection can be reduced and still offer the same result, as a result of which the development of important infrastructure will become more economical. Furthermore, the sound protection components in accordance with the invention can be erected more rapidly as a result of their lower thickness, because they are easier to handle as a result of the dimensions and the construction of the foundations will progress more rapidly as a result of the need for less space.

As a result, the duration in which an important traffic route will be blocked partly or entirely by a construction site will be reduced, thereby reducing the damage to the general economy which is caused by traffic jams. Furthermore, more sound protection components can be transported on a transport device and the transport costs and emissions can be kept at a low level in the erection of the components.

The sub-claims relate to further advantageous embodiments of the invention.

Reference is hereby made expressly to the wording of the claims, by means of which the claims shall be regarded as inserted at this point into the description by reference and shall be regarded as being reproduced literally.

BRIEF DESCRIPTION OF THE DRAWING

The invention will be explained in closer detail by reference to the enclosed drawings which merely show preferred embodiments by way of example, wherein:

FIGS. 1 to 4 show a sound protection component 1, comprising an absorber element 2 and a reflection element 3, wherein the absorber element 2 is of self-supporting design.

DETAILED DESCRIPTION OF PREFERRED EMBODIMENTS

Figure 1:
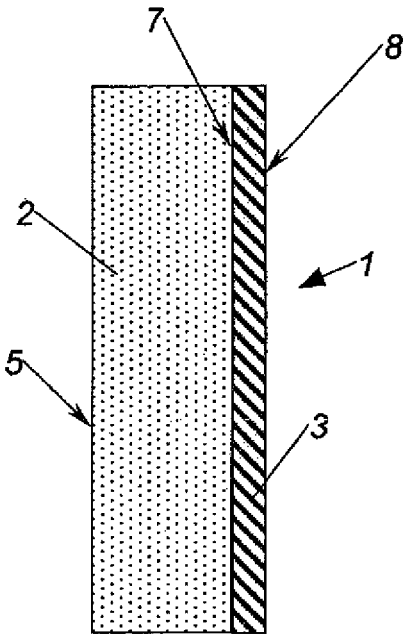
FIG. 1 shows a first preferred embodiment of the sound protection component in a cross-sectional view.

This leads to the advantage that the sound protection component 1 can be thinner than conventional sound protection components in combination with the same noise protection properties. As a result, the area required for sound protection will decrease. Consequently, noise protection can be improved in areas where there is little available space for sound protection such as on bridges or in cities. The input of material for sound protection can be reduced and still offer the same results, thereby making the development of important infrastructure more economical. Furthermore, the sound protection components 1 can be erected more rapidly as a result of their low thickness, since they are easier to handle due to their dimensions and the construction of the foundations will progress more rapidly due to the lower need for space. Consequently, the duration in which an important traffic route will be blocked partly or entirely by a construction site will be reduced, thereby reducing the damage to the general economy which is caused by traffic jams.

The sound protection component 1 is preferably a component which allows or offers protection from sound or noise. Protection from sound or noise shall mean in this context a reduction of the acoustic pressure or acoustic intensity by the sound protection component 1, which is arranged between a sound source and an area to be protected from high noise exposure. It preferably comprises any kind or means of reducing this acoustic pressure level or this acoustic intensity by the sound protection component 1, e.g. by way of sound damping, sound insulation, dissipation losses within the sound protection component 1 and/or reflection losses upon incidence of the sound waves on boundary surfaces.

The sound protection component 1 can preferably be arranged in a substantially plate-shaped manner.

The functionality of the sound protection component 1 is based especially on the physical principles and the connected parameters which will be described below.

The acoustic intensity of a sound wave impinging a component will substantially be reflected, transmitted and dissipated in the component.

The prevention of the transmission of the acoustic intensity by the sound protection component 1 is known as sound insulation. The parameter which is used to state the sound insulation properties of a sound protection component 1 is the sound insulation factor which indicates the ratio between transmitted and incident acoustic intensity in decibels. The prevention of the reflection of the acoustic energy on the sound protection component 1 is known as sound damping or sound absorption. The relevant parameter is the sound absorption factor, which represents the ratio of the non-reflected acoustic intensity to the incident acoustic intensity. Both the sound insulation factor and the sound absorption factor are usually frequency-dependent.

The absorbed acoustic intensity not only relates to the part of the acoustic intensity which is converted into thermal energy, but additionally comprises the transmitted portion of the acoustic intensity. That is why the irreversible conversion of acoustic intensity or acoustic energy into other energy forms such as heat will be designated below for reasons of clarity as dissipation of the acoustic intensity or acoustic energy.

One element which is provided for dissipating a large fraction of the acoustic intensity will be referred to below as the absorber element 2. The dissipation of the acoustic intensity is produced by the structure of an absorber element 2.

One possibility for dissipating the acoustic intensity is the use of resonators such as resonant-absorption silencers or Helmholtz resonators.

A further possibility is the use of porous absorbers. A porous absorber comprises a dense network of cavities or pores which are largely connected to each other and which reach to the surface of the porous absorber. The structure of an absorber element can therefore be compared to a sponge and not to a foam which has enclosed cavities. A sound wave which impinges on the surface of such a porous absorber will only be reflected to a low amount; the larger part penetrates the interior of the porous absorber where the sound will produce oscillations in a gas contained in the pores and/or the cavities. A fraction of this acoustic energy will be converted into thermal energy and therefore dissipated by friction between the gas oscillating in the pores or cavities and the solid material of the porous absorber. The larger the volume of the porous absorber, the larger the fraction of the dissipated acoustic intensity. The solid material of a porous absorber can be made of a fibrous material such as mineral wool, textiles or wood wool, or bonded bulk material such as glued rubber chips or mineral or organic bulk material that is bonded by cement.

It can be provided in a preferred embodiment of the invention that the absorber element 2 is a porous absorber. The absorber element 2 can thus be produced at low cost.

It is provided according to an especially preferred embodiment that the material of the absorber element 2 is a bulk-porous concrete. As a result, the absorber element 2 can easily be produced in large numbers, is resistant to weathering, and further comprises good static properties.

It is provided according to an especially preferred embodiment that the bulk-porous concrete of the absorber element 2 comprises aggregates with a loose unit weight of between 2000 kg/m$^3$ and 3000 kg/m$^3$. The aggregates preferably concern mineral and/or organic grains or particles. The absorber element 2 thus has better static properties than the conventional bulk-porous lightweight concrete.

It is especially preferably provided that the aggregates have a loose unit weight of between 2700 kg/m$^3$ and 2900 kg/m$^3$. The loose unit weight designates the density of the granular framework, therefore without the free intermediate spaces between the individual grains. It is further preferably provided that the aggregates have a bulk density of more than 1200 kg/m$^3$, wherein the bulk density designates the density by including the intermediate spaces between the individual grains or particles, therefore the entire mass relating to the entire volume.

It is provided according to the preferred embodiments, and especially for simple formation of the pores, that the aggregates comprise particles with predeterminable grain sizes. Grain fractions of 2/4 mm, 4/8 mm or 8/12 mm are preferably provided, wherein the statement of 2/4 mm indicates that the aggregates comprise grains with dimensions and grain sizes (aka grain size distribution) of 2 mm to 4 mm. In addition, aggregates with a grain size of 0 to 1 mm can respectively be provided to a low extent. The size of the pores can be predetermined in a simple manner already during the production process by the choice of the grain sizes. It was noticed that the effective frequency range can be influenced by the size of the pores.

It can further be provided for forming the pores that the particles of the aggregates have an unsteady particle-size distribution curve. An unsteady particle-size distribution curve designates the fact that specific predeterminable grain sizes are not present in the aggregates. A predetermination of the nature, number and size of the pores can also be achieved thereby. The pores are formed in the two aforementioned preferred embodiments of the absorber element 2 by free intermediate spaces between the individual particles of the aggregates, as already explained above.

For the purpose of improving static properties of the absorber element 2, it is preferably provided that a reinforcement is arranged in the absorber element 2. The reinforcement can preferably be arranged to comprise metal. A substantially corrosion-proof reinforcement is preferably provided, because humidity can easily penetrate the interior of the absorber element 2 as a result of the cavities. It can especially be provided that the reinforcement comprises galvanised steel. It is provided in a further development of the invention for the purpose of good connection of the reinforcement with the absorber element 2 which is penetrated by the cavities in part that the reinforcement is arranged as an at least two-dimensional supporting structure or construct.

An absorber element 2 which is arranged in such a way can achieve a high sound absorption factor in combination with relatively low thicknesses, and can ensure static carrying capabilities. It was noticed however that as a result of the porous configuration disproportionately large wall thicknesses would be required for the demands of sound insulation.

In order to increase the sound insulation factor of the sound protection component 1, the sound protection component 1 comprises a reflection element 3 in addition to the absorption element 2. The sound insulation factor can be increased by this reflection element 3. However, the sound absorption factor is also decreased as a result.

The reflection element 3 can be arranged differently from the reinforcement in an especially preferred manner. The reinforcement is mainly used for the purpose of improving or predetermining the mechanical stability and especially the impact behaviour, i.e. the behaviour of the sound protection component 1 during impact with a vehicle. In contrast, the reflection element 3 is used for predetermining the acoustic properties of the sound protection component 1 and contributes only irrelevantly to the mechanical properties. This leads to the advantage that a sound protection component 1 with optimised mechanical or acoustic properties can be produced in a substantially simpler way because the reinforcement can be optimised to the mechanical properties and the reflection element 3 to the acoustic properties. Since the reflection element 3 does not assume any mechanical tasks, the reflection element can be made in an especially simple way from easily available material.

The reflection element 3 is preferably substantially plate-shaped, wherein especially the surface normal of the reflection element 3 is substantially parallel to the direction of the thickness of the absorber element 2. Substantially plate-shaped shall mean in this connection that there is a substantially flat shape which has the same thickness everywhere and which is delimited on two opposite sides from one respective flat area which is very extensive in relation to the thickness. This leads to the advantage that the sound protection component 1 can be arranged in a substantially simpler way because the production of the sound protection component is substantially simplified by the substantially plate-shaped reflection element 3, since a substantially plate-shaped reflection element 3 is easy to produce and no steps are necessary in the production in order to keep the shape and position of the reflection element 3 in a stable way during casting of the absorption element 2, since a plate-shaped reflection element 3 can simply be placed on a still flowable absorption element 2 without the reflection element 3 sinking into said absorption element.

The total area of the reflection element 3 is preferably smaller than or equal to the total area of the absorber element 2.

It can be provided that the height or length of the reflection element 3 is a smaller than the height or length of the absorber element 2. This not only leads to an increase in the sound insulation factor in part but also to a reduction of the sound absorption factor by using simple means.

It can further be provided that the reflection element 3 is arranged in several parts and is arranged for example in form of parallel slats or strips.

The reflection element 3 can be embedded in the absorber element 2, wherein the edge of the sound protection component 1 is merely formed by the absorber element 2.

It can also be provided in other embodiments of the sound protection component 1 that the reflection element 3 forms a part of the edge the sound protection component at least in part, especially on at least one side of the sound protection component 1.

It can also be provided that the edge of the reflection element 3 substantially corresponds to the edge of the sound protection component 1.

Since the reflection of the sound wave substantially occurs on the boundary surface between the absorber element 2 and the reflection element 3, the thickness of the reflection element 3 can be low.

Preferably, the thickness of the reflection element 3 can be smaller than or equal to 5 cm, preferably smaller than or equal to 3 cm, especially smaller than or equal to 1 cm.

The reflection element 3 shall preferably have such a high wave impedance that a large part of the sound waves coming from the absorber element 2 is reflected.

In a preferred embodiment the wave impedance of the reflection element 3 differs from the wave impedance of the absorber element 2. As a result, the structure-borne sound of the absorber element 2, i.e the sound which propagates in the solid material of the absorber element 2, can also be reflected.

It is further preferably provided that the reflection element 3 is substantially free from pores and/or cavities, wherein the reflection element 3 offers high sound insulation.

It can especially be provided that the reflection element 3 is arranged to comprise non-metals. Such non-metals can be minerals, plastic or organic materials, bonded mixtures of construction materials such as concrete, or composites of such materials. As a result, the reflection element 3 can also be arranged over a large area in combination with low input of material. Furthermore, such materials are easier to process than steel which can be used in reinforcement for example.

It can be provided according to an especially preferred embodiment that the material of the reflection element 3 is a concrete and/or a fibre cement and/or an impregnated knitwear made of fabric and/or a plastic mat. As a result, the reflection element 3 can be arranged with good acoustic and mechanical properties in combination with low production effort.

It is provided in accordance with the invention that the absorber element 2 is arranged in a self-supporting manner. As a result, no additional support constructions are especially necessary and nearly the entire volume of the sound protection component 1 can be used for dissipation of the acoustic intensity.

It can be provided according to one embodiment that the sound protection component 1 is arranged as a sound insulation panel for a noise protection wall.

In accordance with another embodiment, a noise protection wall is provided with sound protection components 1 in accordance with the invention.

It can be provided according to a further development of the invention that the reflection element 3 is arranged in direct contact with the absorber element 2. The need for space of the sound protection component 1 can thus advantageously be reduced even further.

It can be provided in a further development of the invention that the reflection element 3 is fixed to the absorber element 2. As a result, no support construction for the reflection element 3 is necessary, by means of which the need for space and the input of materials can be reduced.

This fixing can occur for example by means of a screwed joint and/or gluing and/or mechanical meshing.

If the absorber element 2 is flowable during production, the connection can occur in the flowable state and/or during setting.

If the reflection element 3 is flowable during production, the connection can occur in the flowable state and/or during setting.

FIG. 1 shows a first preferred embodiment. This first preferred embodiment comprises the plate-shaped absorber element 2 and the adjacent plate-shaped reflection element 3. The side of the sound protection component 1 which comprises the absorber element 2 as the outer surface is the first side. The side which comprises the reflection element 3 as the outer surface is the second side.

According to the first preferred embodiment, the absorber element 2 is made of bulk-porous concrete and the reflection element 3 of fibre cement.

It is preferably provided in use that the first side faces a source of noise.

A sound wave which originates from a source of noise facing the first side will largely enter the absorber element 2 through a first low-reflection boundary surface 5 where parts of its energy will be dissipated. The sound wave transmitted through the absorber element 2 will impinge with reduced acoustic intensity on a first reflective boundary surface 7 of the reflection element 3, wherein a large part of the acoustic intensity will be reflected. The non-reflected part of the acoustic intensity which has penetrated the reflection element 3 will subsequently largely be emitted again by the second reflective boundary surface 8. This transmitted acoustic intensity is only a fraction of the original acoustic intensity, thereby achieving good sound insulation. The acoustic intensity reflected on the first reflective boundary surface 7 will be reduced again by the absorber element 2 and finally largely emitted by the first low-reflection boundary surface 5. This reflected part of the acoustic intensity (as seen from the first side) will be reduced mainly by dissipation in the absorber element 2, thereby achieving good sound absorption. A sound wave coming from the outside to the second side will mainly be reflected by the second reflective boundary surface 8 of the reflection element 3.

Figure 2:
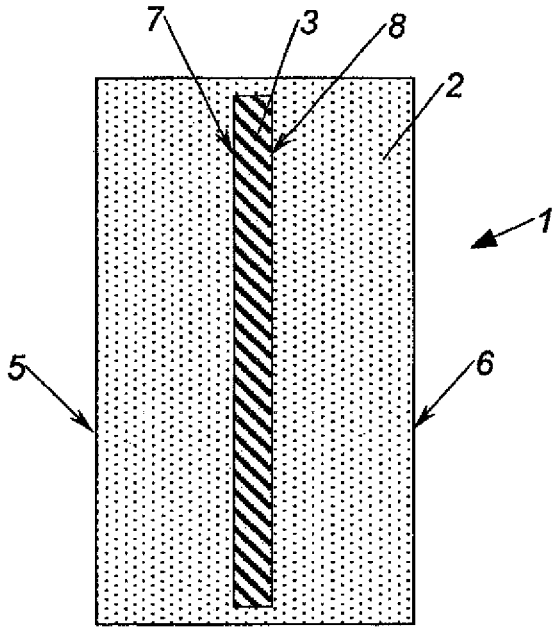
FIG. 2 shows a second preferred embodiment of the sound protection component in a cross-sectional view.

In accordance with a second preferred embodiment which is shown in FIG. 2 and represents a further development of the first preferred embodiment, it can be provided that the reflection element 3 is embedded in the absorber element 2. As a result, good sound absorption can be achieved on both sides. Consequently, additional fixing of the reflection element 3 can be omitted, thus eliminating a further work step or a potential source of errors. As a result, the reflection element 3 can be embedded in the absorber element 2 already during the production process of the absorber element 2, thereby eliminating subsequent attachment. As a result, the reflection element 3 is better protected from external influences, thereby increasing the selection of potential materials for the reflection element 3 because its UV compatibility need not be taken into account for example.

This second preferred embodiment comprises the plate-shaped absorber element 2 and the plate-shaped reflection element 3, wherein the plate-shaped reflection element 3 is embedded in the absorber element 2.

The total area of the reflection element 3 is slightly lower than the total area of the absorber element 2, as a result of which the absorber element 2 will not be separated by the reflection element 3 and is therefore integral in its configuration. It can be provided that the external dimensions of the reflection element 3 substantially correspond to those of the sound protection component 1.

The absorber element 2 comprises the first low-reflection boundary surface 5 which forms a part of the surface of the sound protection component 1, and a second low-reflection boundary surface 6 which is opposite of the first low-reflection boundary surface 5 and also forms a part of the surface of the sound protection component 1.

The first reflective boundary surface 7 and the second reflective boundary surface 8 are situated in the second preferred embodiment in the interior of the sound protection component 1.

In the event that in the second preferred embodiment a sound wave will impinge from the outside on the first low-reflection boundary surface 5, the acoustic intensity is very low in the region of the absorber element 2 between the second reflective boundary surface 8 and the second low-reflection boundary surface 6 as a result of the sound insulation of the reflection element 3. As a result of the low acoustic intensity, only little acoustic energy will be dissipated in this region, as a result of which a region of the absorber element 2 will not be utilised optimally when the sound wave impinges predominantly on one side.

It can be provided in a further development of the invention that the reflection element 3 (as seen in the direction of thickness of the sound protection component 1) is embedded off-centre in the absorber element 2. As a result, the sound absorption factor for both sides of the sound protection component 1 can be chosen differently, by means of which the sound protection component 1 can be adjusted better to the local sound protection requirements. For example, the absorption factor can be higher on the side facing the traffic than on the side facing away from the traffic, in that the thickness of the absorber element 1 is larger on the side facing the traffic than on the side facing away from the traffic, wherein a complex graduation of the acoustic properties of the absorber element 2 can advantageously be avoided. Furthermore, the volume of the absorber element 2 which dissipates less acoustic energy as a result of the lower acoustic intensity can be reduced, by means of which the need for space and the material input can be reduced.

Figure 3:
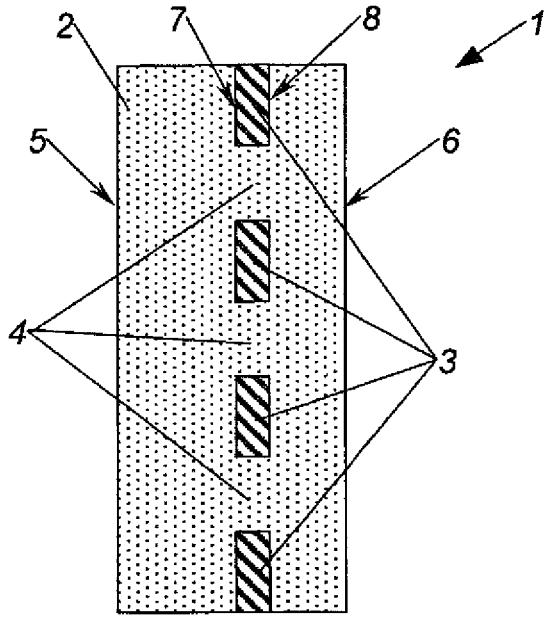
FIG. 3 shows a third especially preferred embodiment of the sound protection component in a cross-sectional view.
Figure 4:
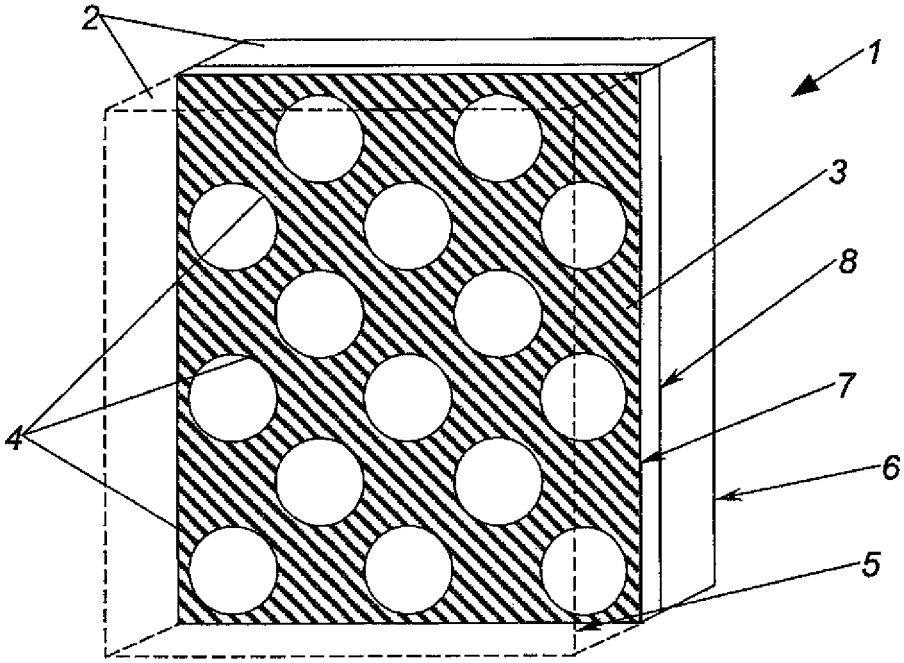
FIG. 4 shows the third especially preferred embodiment of the sound protection component in a cavalier perspective.

FIGS. 3 and 4 show a third especially preferred embodiment, which represents a further development of the second preferred embodiment.

It can be provided according to the third especially preferred embodiment that the reflection element 3 comprises breakthroughs 4. As a result, the thickness of the absorber element 2 can be reduced even further since more volume can be used by the absorber element 2 for the effective dissipation of acoustic energy.

The breakthroughs 4 of the reflection element 3 will be designated below only as breakthroughs 4. The ratio of the area of the breakthroughs 4 of the reflection element 3 to the total area of the reflection element 3 can be chosen freely, as a result of which the sound reflection on the reflection element 3 can be chosen freely over a large range. Consequently, the sound absorption factor can be increased at the expense of the sound insulation factor, or vice versa. The sound protection component 1 can thus be arranged with a thin configuration, wherein the requirements placed on sound insulation and sound absorption are fulfilled precisely.

Furthermore, some or all breakthroughs 4 can be provided with a configuration with open edges, wherein a part of the breakthroughs forms the edge.

The sound insulation factor and sound absorption factor of the sound protection component 1 can be optimised by the thickness of the absorber element 2, the size and/or area of the reflection element 3 and the position of the reflection element 3 in the direction of thickness of the absorber element 2. It is also possible to use only two of these parameters.

It can also be provided that the reflection element 3 is arranged in an angular manner in the sound protection component 1. A different sound insulation factor and/or a different sound absorption factor can be provided in different areas.

It can be provided according to the third especially preferred embodiment that the breakthroughs 4 are filled by the absorber element 2. This improves the static properties of the absorber element 2, by means of which the operational lifespan of the sound protection component 1 will be increased. Furthermore, the security of the traffic participants can be improved because the likelihood of static failure of the sound protection component I in the case of an accident can be reduced.

The shape of the breakthroughs 4 can assume any desired shape. The breakthroughs 4 can be provided for example with the shape of circles, ellipses, squares, rectangles, triangles, strip patterns or more complex areas.

It can be provided according to the third especially preferred embodiment that the breakthroughs 4 are arranged as a perforated structure. As a result, the breakthroughs can be produced with little effort. Furthermore, the reflection element 3 can be provided with an integral configuration, thereby simplifying the embedding of the reflection element 3 in the absorber element 2. The integral arrangement of the reflection element 3 further provides mechanical advantages by the connection between the absorber element 2 and the reflection element 3.

The distribution of the breakthroughs 4 in the reflection element 3 can be provided in different ways. For example, the breakthroughs 4 can be distributed at random or provided in groups.

It can be provided according to the third preferred embodiment that the breakthroughs 4 are arranged in the manner of a chessboard. As a result, an even distribution of the effect of the breakthroughs 4 can be achieved, thereby utilising the absorber element 2 in an optimal manner for dissipating the acoustic energy.

It can preferably be provided in a noise protection wall with at least one sound protection component 1 that the ratios of the area of the breakthroughs 4 to the total area of the at least one reflection element 3 is variable in at least one direction. The frequency and/or the size of the breakthroughs 4 can vary in one direction for example, e.g. the direction of height or the longitudinal direction. As a result, the acoustic properties of the sound protection component can further be adjusted to the local needs for sound protection.

It can be provided for example that in a sound protection component 1 the ratio of the area of the breakthroughs 4 to the total area of the reflection element 3 has a gradient in one direction, preferably the direction of height of the sound protection component 1.

Furthermore, the sound close to the ground can be dampened more strongly in a sound protection component 1 adjacent to a traffic route, and the area of the sound protection component 1 that is situated at a higher level will absorb the sound more strongly which reaches the areas to be detected by reflection or diffraction.

In the case of a noise protection wall which consists of several sound protection components 1 arranged as sound protection panels, the inserted sound protection panels can be provided in the direction of height with different ratios of the area of the breakthroughs 4 to the total area of the reflection element 3.

It can be provided according to a further development of the invention that the ratio of the area of the breakthroughs 4 to the total area of the reflection element 3 of the inserted noise protection panels of a noise protection wall is different along the direction of height and/or a longitudinal direction of the noise protection wall. As a result, areas such as housing premises situated close to the traffic route can be taken specifically into account in noise protection.

Further embodiments in accordance with the invention merely comprise a part of the described features, wherein any combination of features can be provided, which also includes such of different described embodiments.

The invention claimed is:

1. A noise protection wall for traffic routes comprising:

a sound protection component, said sound protection component comprising an absorber element arranged in a self-supporting manner, said absorber element being constructed as a porous absorber and provided with a substantially corrosion-proof reinforcement comprising metal arranged in the absorber element, said reinforcement being constructed as an at least two-dimensional supporting structure; and a plate-shaped reflection element having opposing parallel surfaces and being embedded in the absorber element and constructed different from the reinforcement, said plate-shaped reflection element predetermining acoustic properties of the sound protection component and insignificantly contributing to mechanical properties of the absorber element, wherein a surface normal of the parallel surfaces of the plate-shaped reflection element is parallel to a thickness direction of the absorber element, wherein the material of the absorber element is a bulk-porous concrete.

2. The sound protection component of claim 1, wherein the reflection element is arranged in direct contact with the absorber element.

3. The sound protection component of claim 1, wherein the reflection element is arranged off-centre in the absorber element, as seen in the direction of thickness of the sound protection component.

4. The sound protection component of claim 1, wherein the reflection element comprises breakthroughs.

5. The sound protection component of claim 4, wherein the breakthroughs are filled by the absorber element.

6. The sound protection component of claim 4, wherein the breakthroughs are arranged as a perforated structure.

7. The sound protection component of claim 1, wherein the material of the reflection element is a concrete and/or a fibre cement and/or an impregnated knitwear made of fabric and/or a plastic mat.

8. The sound protection component of claim 1, arranged as a sound protection panel for a noise protection wall.

9. The sound protection component of claim 1, wherein a thickness of the reflection element is less than or equal to 5 cm.

10. The sound protection component of claim 9, wherein the thickness of the reflection element is less than or equal to 3 cm.

11. The sound protection component of claim 9, wherein the thickness of the reflection element is less than or equal to 1 cm.

* * * * *